US005292232A

United States Patent [19]

Krohn et al.

[11] Patent Number: 5,292,232

[45] Date of Patent: Mar. 8, 1994

[54] LIQUID PUMP PRESSURE CONTROL SYSTEM

[75] Inventors: Duane D. Krohn; Dean L. Schaffran, both of Westminster, Colo.

[73] Assignee: Graco Inc., Golden Valley, Minn.

[21] Appl. No.: 5,588

[22] Filed: Jan. 19, 1993

[51] Int. Cl.[5] ..... F04B 49/08

[52] U.S. Cl. ..... 417/44 A; 417/234; 200/82 C

[58] Field of Search ..... 417/44 A, 15, 234; 73/745, 146.8; 200/82 C, 82 A

[56] References Cited

U.S. PATENT DOCUMENTS

| | | | |
|---|---|---|---|
| 2,800,548 | 7/1957 | Stary | 200/82 C |
| 4,009,971 | 3/1977 | Krohn et al. | 417/43 |
| 4,212,591 | 7/1980 | Lamontagne et al. | 417/38 |
| 4,323,741 | 4/1982 | Krohn . | |
| 4,335,999 | 6/1982 | Lamontagne et al. | 417/38 |
| 4,397,610 | 8/1983 | Krohn | 417/44 |
| 4,638,132 | 1/1987 | Miller | 73/745 |

*Primary Examiner*—Richard A. Bertsch
*Assistant Examiner*—David W. Scheuermann
*Attorney, Agent, or Firm*—Palmatier, Sjoquist & Helget

[57] ABSTRACT

A self-contained liquid manifold attachable to a drive mechanism for a reciprocable pump, the manifold having a pumping cylinder, pressure transducer, pressure control mechanism, drain valve and control mechanism attached thereto, and liquid delivery outlets all forming a part thereof. The manifold and its associated components are removable from the reciprocable drive mechanism by detaching two fasteners. The pressure transducer and control mechanism includes a piston and cylinder removably indexed in a manifold bore, and an electrical switch in an adjacent housing with a ball bearing on the piston and a push rod resting on the ball bearing, the other push rod end constrained by a ball and spring combination.

17 Claims, 3 Drawing Sheets

LIQUID PUMP PRESSURE CONTROL SYSTEM

BACKGROUND OF THE INVENTION

The present invention relates to systems for pumping liquids under relatively high pressures. More particularly, the invention relates to a portable system for pumping liquids, wherein liquid pressure is regulated by a transducer which develops electrical control signals for controlling an electric motor drive source.

The present invention is primarily adaptable for use with portable high-pressure spraying systems for spraying coating materials such as paint and the like. However, the invention is also adaptable for use in connection with any high-pressure liquid spraying system, particularly of a portable nature wherein the driving force is an electrical motor or equivalent. Portable spraying systems of this general classification are known in the art, and are generally typified by an electrical motor drive source which is mechanically linked to drive a reciprocable pump, wherein the liquid pressure is controlled by a pressure transducer coupled to an electric motor switching circuit. The pressure transducer monitors the liquid output pressure from the pump, and controls a switching circuit which applies an electrical driving voltage to the motor when the monitored pressure drops below a predetermined or preset amount, and provides a motor shut-off control signal whenever the pressure exceeds a predetermined or preset higher value.

Portable pumping systems of the type generally related to the present invention are disclosed in U.S. Pat. No. 4,009,971, issued Mar. 1, 1977, and U.S. Pat. No. 4,397,610, issued Aug. 9, 1983. The '971 patent discloses a portable pumping system having a positive on/off motor control, wherein a pressure transducer is connected into a liquid manifold and may be preset to a predetermined pressure which causes the transducer to activate an electrical switch for controlling power delivered to the motor. The '610 patent discloses a variable speed motor utilizing a pressure transducer to generate a variable drive voltage to the motor, to slow down and speed up the drive motor in response to pressure fluctuations. Various forms of pressure transducer have been developed for use in connection with pumps of the general type associated with the present invention. For example, U.S. Pat. No. 4,212,591, issued Jul. 15, 1980, discloses a pressure transducer which senses the expansion and contraction of a flexible pressure hose as a means for determining liquid pressure. The U.S. Pat. No. 4,335,999, issued Jun. 22, 1982, discloses a further variation of the flexible hose sensing mechanism. U.S. Pat. No. 4,323,741, issued Apr. 6, 1982, discloses a Bourdon tube construction wherein the deflection of the Bourdon tube causes a switch activation to occur. The aforementioned '971 patent discloses a pressure transducer comprising a slidable piston rod responsive to pressure, the piston rod having a threadable knob at its distal end, the knob being engageable against a pin which is movable to contact a switch lever. Each of the foregoing patents disclose various forms of reciprocable drive liquid pumping cylinders having an output liquid delivery line coupled to a pressure sensor, via either a simple manifold or liquid flow-through device, and an output delivery line coupled to the pressure sensor mechanism.

SUMMARY OF THE INVENTION

The present invention comprises a portable reciprocable drive pumping system having a liquid manifold affixed directly to the pumping cylinder, the manifold receiving pressurized liquid delivered from the cylinder, a pressure transducer coupled into a liquid delivery chamber in the manifold, with an adjustable pressure setting device linked to the pressure transducer, and a pressure relief valve system also coupled to the manifold chamber. The single manifold therefore accommodates all of the liquid delivery, pressure setting and pressure relief functions of the portable pumping system. The pressure transducer and pressure setting mechanism includes a slidable piston in liquid contact in the manifold, the slidable piston having a projecting stem which engages a spherical bearing, the bearing also engaging a spring-loaded push rod located in an adjacent housing, the push rod being engageable into movable contact against a switch lever, the switch lever controlling a switch for switching electric motor power on/off.

It is the principal object of the present invention to provide a portable reciprocable drive pumping system having all of the liquid delivery functions confined to a compact unit.

It is another object of the present invention to provide a single manifold directly connected to a reciprocable piston and cylinder, the manifold housing all of the pressure delivery, sensing and relieving functions for the system.

It is a further object of the present invention to provide a pressure transducer in direct liquid contact within the manifold chamber, the transducer being externally linked to a movable bearing surface.

It is yet another object of the present invention to provide a pressure control mechanism linked to the aforesaid movable bearing surface, and coupled to a power switch, all of which are external to the liquid delivery components of the system.

The foregoing and other objects and advantages of the invention will become apparent from the following specification and claims, and with reference to the appended drawings.

DESCRIPTION OF THE PREFERRED EMBODIMENT

Figure 1:
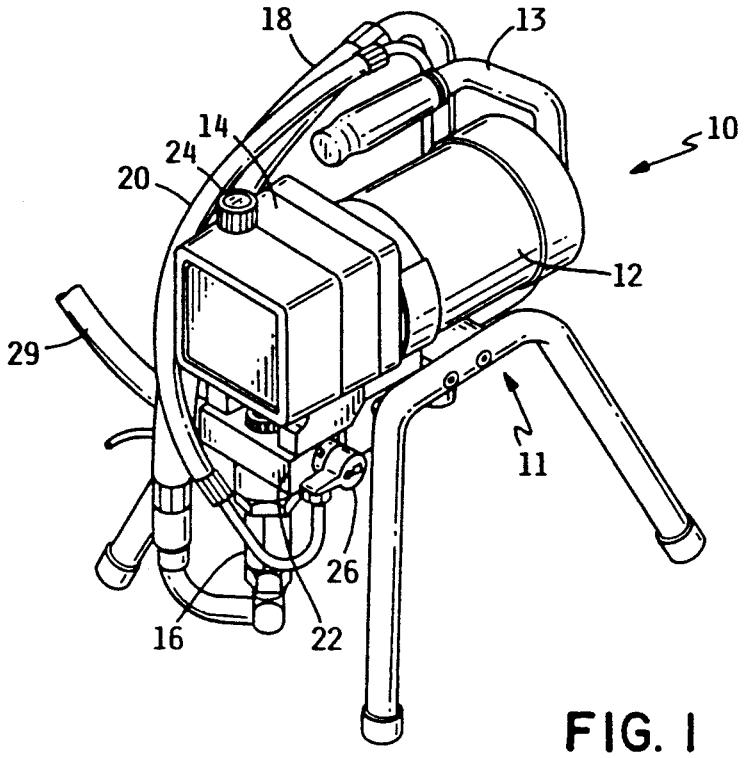
FIG. 1 shows an isometric view of a portable pumping system of the type associated with the present invention.

Referring first to FIG. 1, the portable pumping system 10 of the present invention is shown in isometric view. A drive motor 12 is mounted on a portable stand 11 which is movable by a handle 13. The drive motor 12 is mechanically connected via a gear box 14 to drive a reciprocable pump 16. The reciprocable pump 16 is connected to a manifold 22 for receiving the liquid delivered by the pump 16. A suction hose 18 is connected to the pump 16, for insertion into a container of the liquid being pumped. A liquid drain hose 20 is connected to the manifold 22, and is controllable by a drain knob 26, to relieve pressurized liquid into the drain hose 20, which is typically placed into the same container as the suction hose 18. A pressure adjustment knob 24 is connected to the manifold 22 for providing a preferred delivery pressure setting.

Figure 2:
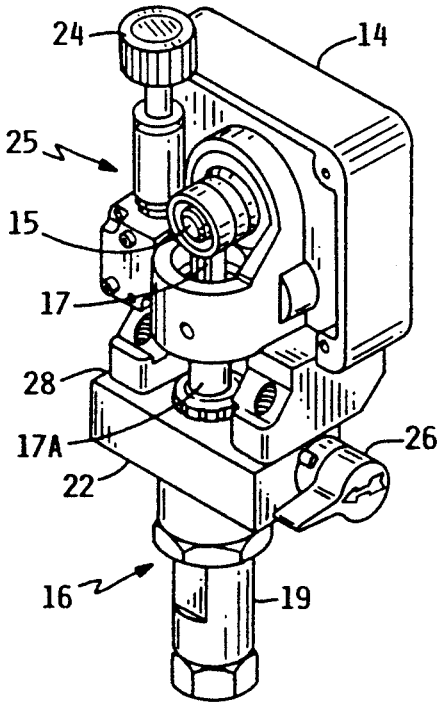
FIG. 2 shows an isometric view of the liquid delivery components of the invention.

FIG. 2 shows an isometric view of the liquid delivery components of the present invention. The liquid delivery components are affixed to the gear box 14 which has a projecting crankshaft 15 coupled to a connecting rod 17, which is coupled to a piston rod 17*a*. The piston rod 17A is reciprocable within a cylinder 19 to form the pump 16. The pump 16 has a liquid delivery passage (not shown) coupled directly into manifold 22. A liquid outlet 28 is connected to a liquid delivery hose 29 and also coupled to manifold 22, and pressure adjustment knob 24 is attached to a pressure-sensing mechanism 25 which is also affixed to gear box 14 and is coupled via a pressure transducer into manifold 22. The manifold 22 is preferably bolted to the underside of the gear box 14 housing.

Figure 3:
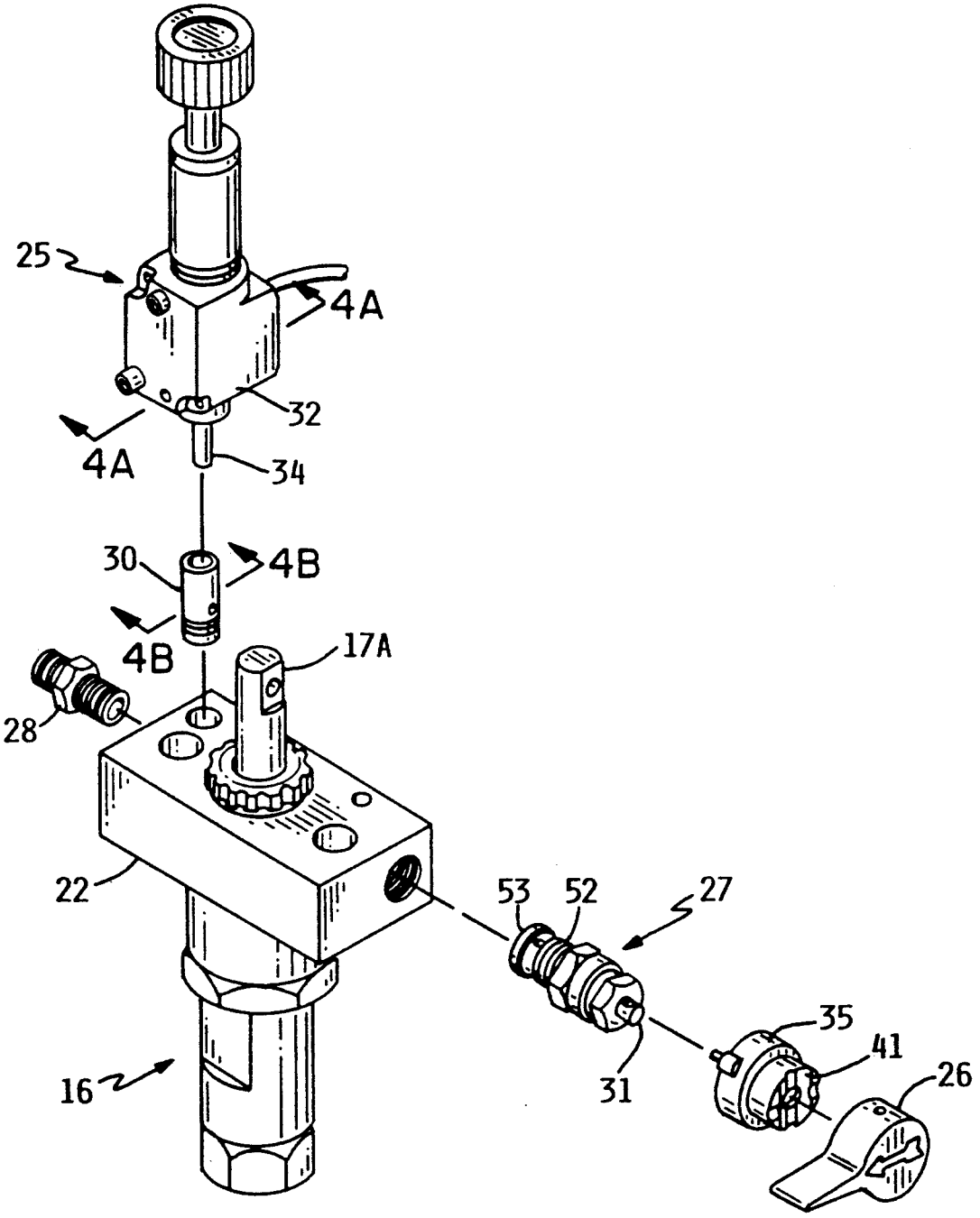
FIG. 3 shows a partially exploded view of the manifold of the present invention, including associated and connected components.

FIG. 3 shows an isometric and exploded view of the liquid delivery components of the invention. Manifold 22 forms a common housing for mounting all of the components associated with the liquid delivery function. For example, pump 16 is affixed to an opening in the bottom of manifold 22, liquid outlet 28 is affixed to an opening through one side of manifold 22, drain valve 27 is affixed into an opening on another side of manifold 22, and pressure transducer 30 is inserted into a further opening in manifold 22. The pressure setting mechanism 25 is attached to a switch box 32 and a push rod 34 projects from the underside of switch box 32 to engage the movable components of pressure transducer 30, to be hereinafter described. A liquid delivery hose 29 may be connected to liquid outlet 28 for delivering the pumped liquid over extended distances, as for example to a spray gun or the like.

Drain valve 27 is threadably affixed into manifold 22, and has a valve rod 31 projecting externally therefrom. Valve rod 31 extends through an opening in switch detent cover 35, and is secured to drain knob 26 by means of a pin or other locking mechanism. Switch detent cover 35 has two detent positions to identify preferred positions for drain knob 26, the two positions being at different elevations, so as to pull valve rod 31 outwardly from drain valve 27 when knob 26 is rotated to one of these positions. The outer surface 41 of switch detent cover 35 provides the necessary grooved detent surfaces and the raised surface for pulling valve rod 31 outwardly when knob 26 is rotated.

Figure 4A:
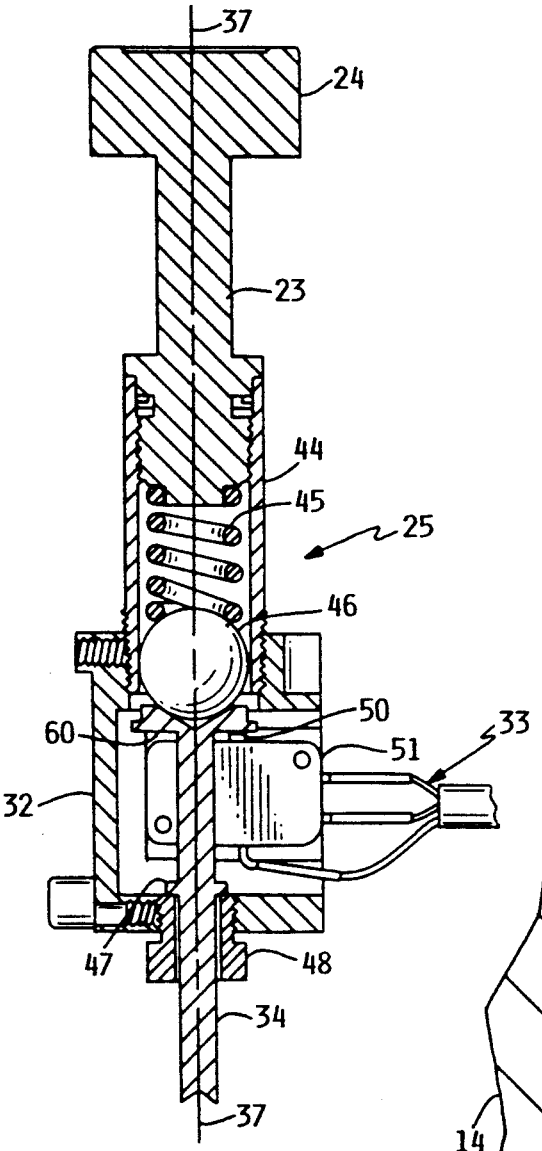
FIG. 4A shows a cross-sectional view of the pressure control mechanism taken along the lines 4A—4A of FIG. 3.
Figure 4B:
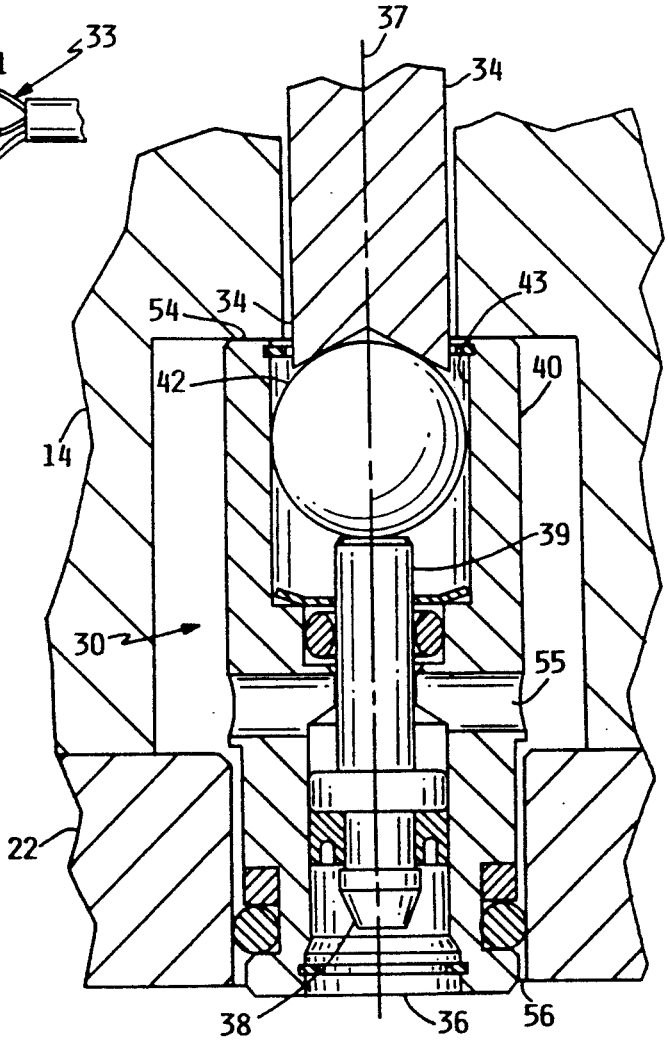
FIG. 4B shows a cross-sectional view of the pressure transducer of the invention, taken along the lines 4B—4B of FIG. 3.

FIG. 4A shows a cross-sectional view of the pressure setting mechanism 25 which is coupled to the pressure transducer 30, and FIG. 4B shows a cross-sectional view of pressure transducer 30. Pressure transducer 30 is sealably inserted into an opening in manifold 22, so as to expose the bottom opening 36 of pressure transducer 30 to the interior of manifold 22. A slidable piston 38 is therefore exposed to the internal liquid pressures within manifold 22, and piston 38 is movable along vertical axis 37 in response to pressure variations within manifold 22. Pressure transducer 30 is not threadably attached to either manifold 22 or gear box housing 14, and is therefore free to move along axis 37 to a position which is determined by mechanical contact of the top surface 54 against the housing comprising gear box 14. Fluid pressure acting against O-ring seal 56 provides a liquid seal preventing liquid in manifold 22 from escaping through the pressure transducer bore. The positive stop afforded by the housing for gear box 14 assures that pressure transducer 30 will always be positioned at the same point along axis 37, thereby simplifying calibration procedures whenever the unit is disassembled for service or repair.

Piston 38 has a projecting rod 39 which is slidable but sealably projecting into an upper housing 40 of transducer 30. A spherical ball 42 rests atop the end of rod 39 and is movable therewith. Upper housing 40 has an interior bore 43 which is sized slightly larger than the diameter of ball 42, so as to permit ball 42 to freely move upwardly and downwardly. The interior of bore 43 is wholly isolated from liquid contact, suitable O-rings and packings being utilized to prevent liquid flow from manifold 22 into bore 43. A leakage passage 55 is provided through upper housing 40 in the event the seal provided by the piston fails.

Pressure setting mechanism 25 is mounted generally along axis 37 in endwise alignment with pressure transducer 30. Pressure adjustment knob 24 is connected to a stem 23 which is threadably insertable into one end of a housing 44. A compression spring 45 is supported in the inner end of stem 23, and a spherical ball 46 is supported at the other end of the compression spring 45. Push rod 34 has a first end contacting spherical ball 46, and a second end contacting spherical ball 42. The range of travel of push rod 34 along axis 37 is limited by a shoulder stop 47 on push rod 34. Stop 47 is confined within switch box 32 by a calibration nut 48, which adjustably positions shoulder stop 47 along axis 37.

A microswitch 51 is mounted inside of switch box 32, and microswitch 51 has an actuator button 50 which is movable by contact with flange 60 on push rod 34. Wires 33 are connected to microswitch 51, so as to provide a switch connection between the "common" terminal and the "normally open" (NO) terminal in one switch position, and between "common" and the "normally closed" (NC) terminal in the other switch position. The signals produced by switch 51 are utilized to drive further electric circuits which turn on and turn off the electric drive motor 12.

Because push rod 34 transfers its linear motion along axis 37 via spherical ball bearings 42 and 46, axial alignment of all of the components is not a critical requirement. Push rod 34 may be axially misaligned relative to rod 39, and push rod 34 may be axially misaligned relative to housing 44 and compression spring 45. The respective spherical balls 42 and 45 engage push rod 34 via respective conical depressions in the ends of push rod 34. This mechanical linkage and coupling mechanism greatly reduces the frictional forces which might otherwise be caused by misalignment of the respective components.

In operation, knob 24 may be threadably adjustable into and out of housing 44, so as to increase and/or decrease the compression force of a spring 45, which acts against ball 46. This compression spring force urges push rod 34 downwardly against ball 42, and the force is transferred further downwardly against rod 39 connected to piston 38. When the liquid pressure within manifold 22 rises to a sufficient level, it acts against the spring force of spring 45 to move push rod 34 upwardly.

Flange 60 also moves upwardly, and at some pressure level the flange 60 releases switch button 50 and causes switch button 50 to switch the microswitch 51. This switch action generates an electrical signal which is coupled through circuitry to turn the drive motor 12 off. As the liquid pressure within manifold 22 decreases, push rod 34 and shoulder flange 60 move downwardly, thereby depressing switch button 50, causing microswitch 51 to switch back into its initial position. Microswitch 51 may be selected from any of a number of well-known commercially available switches, as for example Switch Type V3, manufactured by the Microswitch Division of Honeywell.

Pump 16 acts as a conventional double-acting reciprocable pump, delivering pressurized liquid into manifold 22 during both the pressure stroke and suction stroke portions of its pumping cycle, and this pressurized liquid is passed into a liquid delivery line via outlet 28.

Drain valve 27 may be actuated at any time to relieve liquid pressure from within manifold 22. When the drain knob 26 is rotated to a first position drain valve 27 is caused to pass liquid from manifold 22 into drain hose 20; when knob 26 is placed in a second position, valve 27 is closed and prevents such liquid passage. Drain valve 27 is particularly useful for relieving static liquid pressure buildup which may be retained in manifold 22 after the pump has been operated for some period of time and then shut off. Drain valve 27 may also be used as a cooperating element in the function of priming the pump for initial operation. Drain valve 27 also operates as a safety relief valve, because valve element 53 may be forced open whenever the pressure within manifold 22 exceeds the force of compression spring 52. The spring force may be preset to permit drain valve 27 to operate as a safety relief valve at some preset pressure limit.

Manifold 22 and its associated components are readily removable from the overall device by merely disconnecting the two bolt fasteners which affix the manifold to the underside of the gear box 14, thereby providing for swift and easy maintenance and repair.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. An apparatus for pumping liquid under pressure, comprising:

a) a rotatable shaft drive motor coupled via a crank arm to a piston reciprocable within a cylinder;

b) a manifold affixed adjacent an end of said cylinder, said manifold having an internal chamber and flow passages coupling said chamber to said cylinder;

c) means for coupling a liquid delivery hose to said manifold chamber;

d) a pressure transducer in said manifold having a slidable piston in a passage, said passage being in liquid flow communication to said manifold chamber, and a movable first rod contacting said piston, said first rod extending outside said manifold;

e) a first ball slidably positioned within a channel in said pressure transducer, said ball supported by an end of said movable first rod;

f) a push rod supported by said ball, said push rod having means for actuating an electrical switch;

g) a spring means for urging a force against said push rod in opposition to the force of said movable first rod; and h) an electrical switch positioned adjacent said push rod and actuable by said push rod switch actuating means; whereby said drive motor is controlled by said electrical switch.

2. The apparatus of claim 1, further comprising means for adjusting the force against said push rod.

3. The apparatus of claim 2, wherein said means for adjusting the force further comprises a threaded actuator and compression spring, and a second ball engaged by said compression spring, said second ball contacting said push rod.

4. The apparatus of claim 3, wherein said electrical switch further comprises a microswitch having a switch member engaged by said push rod.

5. The apparatus of claim 4, wherein said push rod further comprises a first end contacting said first ball and a second end contacting said second ball.

6. The apparatus of claim 5, wherein said first movable rod, said first ball, said push rod and said second ball are in proximate axial alignment.

7. An apparatus for monitoring and controlling the pressure delivered by a reciprocable pump liquid pumping system, comprising:

a) a manifold attached to said reciprocable pump, said manifold having an internal chamber and means for receiving liquid from said pump;

b) means for connecting a liquid delivery hose to said manifold;

c) means for connecting a drain hose to said manifold;

d) a pressure transducer in said manifold, said pressure transducer comprising a slidable piston in a passage coupled to said internal chamber, and a first rod connected to said piston and extending outside said manifold;

e) a motor switch in a housing attached to said manifold, said motor switch having an actuator, and an adjustable spring in said housing; and f) a second rod having means at one end for contacting said adjustable spring in said housing, and having means at the other end for contacting said first rod outside said manifold, and having means for contacting said switch actuator.

8. The apparatus of claim 7, wherein said second rod means for contacting said spring further comprises a concave end face on said second rod and a first ball seated against said end face and also seated against said spring.

9. The apparatus of claim 8, wherein said second rod means for contacting said first rod further comprises a second ball interposed between respective ends of said first and second rods.

10. The apparatus of claim 9, wherein said means for contacting said switch actuator further comprises a raised flange on said second rod.

11. The apparatus of claim 10, wherein said motor switch further comprises a microswitch.

12. The apparatus of claim 11, further comprising a spring-biased valve in a bore in said manifold, said spring-biased valve controlling the liquid path between said manifold and said drain hose.

13. An apparatus for pumping liquid under pressure, comprising:

a) a rotatable shaft drive motor and gear box having a reciprocable shaft projecting therefrom;

b) a liquid manifold removably attachable to said gear box, said manifold having a pumping cylinder and reciprocable piston affixed thereto, said piston having means for connecting to said reciprocable shaft;

c) liquid delivery port in said manifold in flow communication with said pumping cylinder;

d) a pressure transducer in said manifold in communication with said liquid delivery port, said pressure transducer having a movable member responsive to liquid pressure at said liquid delivery port;

e) a pressure switch housing spaced from said pressure transducer, said housing having an electrical switch affixed therein, said switch having means for controlling the activation of said drive motor; and f) an actuator rod extending between said pressure transducer movable member and said pressure switch housing, said actuator rod having means for actuating said electrical switch.

14. The apparatus of claim 13, further comprising an adjustable compression spring in said pressure switch housing, and a ball contacting said spring and contacting an end of said actuator rod.

15. The apparatus of claim 14, further comprising a second ball interposed between the other end of said actuator rod and said movable member.

16. The apparatus of claim 15, further comprising a liquid drain port in said manifold and a spring-biased relief valve in said manifold in flow communication with said liquid drain port.

17. The apparatus of claim 16, further comprising means for positioning and means for limiting the movement of said actuator rod.

* * * * *